US007500422B2

(12) United States Patent
Mazur

(10) Patent No.: US 7,500,422 B2
(45) Date of Patent: Mar. 10, 2009

(54) MODULAR FUNCTIONAL STAR-DISC SYSTEM

(76) Inventor: Robert Mazur, 43311 Joy Rd., Canton, MI (US) 48187

( * ) Notice: Subject to any disclaimer, the term of this patent is extended or adjusted under 35 U.S.C. 154(b) by 101 days.

(21) Appl. No.: 11/640,753

(22) Filed: Dec. 18, 2006

(65) Prior Publication Data

US 2007/0137471 A1 Jun. 21, 2007

Related U.S. Application Data

(60) Provisional application No. 60/750,916, filed on Dec. 16, 2005.

(51) Int. Cl.

| | |
|---|---|
| ***F41H 5/02*** | (2006.01) |
| ***F41H 5/24*** | (2006.01) |
| ***F41H 7/00*** | (2006.01) |
| ***E06B 9/00*** | (2006.01) |

(52) U.S. Cl. ..... 89/36.02; 89/36.04; 89/36.07; 428/911; 109/49.5

(58) Field of Classification Search ..... 89/36.01–36.07; 109/49.5; 428/911

See application file for complete search history.

(56) References Cited

U.S. PATENT DOCUMENTS

| | | | | |
|---|---|---|---|---|
| 921,352 | A | 5/1909 | Blaker et al. | |
| 1,021,804 | A | 4/1912 | Scheider | |
| 1,282,411 | A | 10/1918 | Golembiowski | |
| 1,290,799 | A | 1/1919 | Talley | |
| 2,819,759 | A * | 1/1958 | Goodloe | 160/330 |
| 3,523,057 | A * | 8/1970 | Buck | 428/156 |
| 3,563,836 | A | 2/1971 | Dunbar | |
| 3,867,239 | A | 2/1975 | Alesi et al. | |
| 4,648,136 | A * | 3/1987 | Higuchi | 2/2.5 |
| 5,134,725 | A | 8/1992 | Yeshurun et al. | |
| 5,515,541 | A | 5/1996 | Sacks et al. | |
| 5,972,819 | A | 10/1999 | Cohen | |
| 6,035,438 | A | 3/2000 | Neal et al. | |
| 6,112,635 | A | 9/2000 | Cohen | |
| 6,170,378 | B1 | 1/2001 | Neal et al. | |
| 6,200,664 | B1 * | 3/2001 | Figge et al. | 428/178 |
| 6,203,908 | B1 | 3/2001 | Cohen | |
| 6,289,781 | B1 | 9/2001 | Cohen | |
| 6,370,690 | B1 | 4/2002 | Neal | |
| 6,408,734 | B1 | 6/2002 | Cohen | |
| 6,510,777 | B2 | 1/2003 | Neal | |
| 6,575,075 | B2 | 6/2003 | Cohen | |
| 6,745,661 | B1 | 6/2004 | Neal et al. | |
| 6,860,186 | B2 | 3/2005 | Cohen | |
| 6,892,623 | B2 | 5/2005 | Benyami et al. | |

(Continued)

FOREIGN PATENT DOCUMENTS

WO WO 9200497 A1 * 1/1992

*Primary Examiner*—Michael J. Carone
*Assistant Examiner*—Michael D David
(74) *Attorney, Agent, or Firm*—Butzel Long

(57) ABSTRACT

A modular construction system that can be used to construct a variety of structural units including armor shields for vehicles or personnel, energy generating grids, thermal insulating or transmitting structures, acoustic insulating or reflecting structures, electromagnetic shields, etc. The modular construction system uses modular discs which are configured to be coupled or connected together to form or develop any desired structure. The modular discs include substantially circular base portions, star-shaped projections extending from the upper surface of the substantially circular base portion, and cooperating connecting structures that allow for the plurality of modular discs to be connected to one another.

20 Claims, 13 Drawing Sheets

U.S. PATENT DOCUMENTS

2004/0020353 A1 2/2004 Ravid et al.
2005/0072294 A1 4/2005 Cohen
2005/0087064 A1 4/2005 Cohne
2007/0017360 A1* 1/2007 Cohen ..... 89/36.08

* cited by examiner

MODULAR FUNCTIONAL STAR-DISC SYSTEM

RELATED APPLICATION

The present application is based upon U.S. Provisional Patent Application Ser. No. 60/750,916, filed Dec. 16, 2005 to which priority is claimed under 35 U.S.C. §120 and of which the entire specification is hereby expressly incorporated by reference.

TECHNICAL FIELD

The present invention relates to a modular construction system that can be used to construct a variety of structural units including, but not limited to, armor shields for vehicles and personnel, energy generating grids, and thermal or acoustic insulating structures. In particular, the present invention is directed to an interconnecting system of modular discs that can be made of different materials and can be interconnected or coupled together to form a variety of different functional structures.

BACKGROUND ART

The use of discrete impact-absorbing elements in armor shields for vehicles and personal armor articles is known. Such discrete impact-absorbing elements in the form of flat circular discs, hexagon-shaped elements, pellets, etc. are exemplified in the disclosures of U.S. Pat. Nos. 921,352 to Blaker et al., 1,021,804 to Schneider, 1,282,411 to Golembiowski, 1,290,799 to Talley, 3,563,836 to Dunbar, 3,867,239 to Alesi et al., 5,134,725 to Teshurun et al., 5,515,541 to Sacks et al., 5,972,819 to Cohen, 6,035,438 to Neal et al., 6,112,635 to Cohen, 6,170,378 to Neal et al., 6,203,908 to Cohen, 6,289,781 to Cohen, 6,370,690 to Neal, 6,408,734 to Cohen, 6,510,777 to Neal, 6,575,075 to Cohen, 6,745,661 to Neal et al., 6,860,186 to Cohen, and 6,892,623 to Benyami et al., and U.S. Patent Application Publication Nos. 2004/0020353 to Ravid et al., 2005/0072294 to Cohen and 2005/0087064 to Cohen.

In general, the prior art armor shields include discrete impact-absorbing elements that are either arranged in a common plane or otherwise partially overlap to form a continuous protective shield. However, the prior art armor shields are preformed and in general are not designed to be easily repaired in the field.

The present invention provides a modular construction system that can be used to construct a variety of structural units including, but not limited to, armor shields. The modular construction system of the present invention allows quick and easy field construction and repair as well as the construction of multi-layered protection.

DISCLOSURE OF THE INVENTION

According to various features, characteristics and embodiments of the present invention which will become apparent as the description thereof proceeds, the present invention provides a modular construction system for assembling structural units which includes a plurality of modular discs, each of said plurality of modular discs includes:

a substantially circular base portion having an upper surface, a lower surface and a radius;

a star-shaped projection extending from the upper surface of the substantially circular base portion, said star-shaped projection having an upper surface and four inwardly curved side walls wherein the four inwardly curved side walls have a radius of curvature that is substantially equal to the radius of the substantially circular base portion; and cooperating connecting structures provided on the lower surface of the substantially circular base portion and on the upper surface of the star-shaped projection which cooperating connecting structures allow for the plurality of modular discs to be connected to one another.

The present invention further provides a method of assembling a structure which involves:

a) providing a plurality of modular discs, each of said plurality of modular discs including:

i) a substantially circular base portion having an upper surface, a lower surface and a radius;

ii) a star-shaped projection extending from the upper surface of the substantially circular base portion, said star-shaped projection having an upper surface and four inwardly curved side walls wherein the four inwardly curved side walls have a radius of curvature that is substantially equal to the radius of the substantially circular base portion; and iii) a cooperating connecting structures provided on the lower surface of the substantially circular base portion and on the upper surface of the star-shaped projection which cooperating connecting structures allow for the plurality of modular discs to be connected to one another; and b) connecting the plurality of modular discs together to form a structure.

BRIEF DESCRIPTION OF DRAWINGS

The present invention will be described with reference to the attached drawings which are given as non-limiting examples only, in which.

BEST MODE FOR CARRYING OUT THE INVENTION

The present invention is directed to a modular construction system that can be used to construct a variety of structural units including, but not limited to, armor shields for vehicles and personnel, energy generating grids, and thermal or acoustic insulating structures, and a variety of other structures and structural units. The modular construction system includes a plurality of modular discs that are configured so that they can be interconnected or coupled together to form a variety of different functional structures. The modular discs are particularly configured so that they can be coupled together to form a continuous composite structure, which can function as an armor shield, a thermal or acoustic barrier, an energy generating grid, etc., depending on the nature of the modular discs.

For armor shielding, the modular discs can contain energy absorbing and diffusing materials that are packaged in casings that can be made of any suitable metal, ceramic, plastic, or other structurally and mechanically sturdy material. In alternative embodiments, the modular discs can be made entirely or substantially entirely from materials that absorb energy, provide armament, provide impact protection, provide thermal insulation or transmission, provide acoustic absorption or reflect acoustic energy, provide electromagnetic shielding, etc.

The modular discs are coupled or connected together by a unique interlocking mechanism which involves cooperating connecting structures provided on the upper and lower surfaces the modular discs which cooperating connecting structures allow for the plurality of modular discs to be connected to one another. The interlocking mechanism can include keyed locking projections on one side of the modular discs and complementarily shaped slots on opposite sides of the modular discs into which the keyed locking projections can be received and rotated to lock adjacent modular discs together. The keyed locking mechanism enables modular discs to be easily and quickly coupled or connected together and further prevents incorrect insulation of the modular discs. Repair and/or replacement of modular discs in a structural assembly can be accomplished quickly and easily without any auxiliary tools.

The modular discs can be provided with internal electrical leads and external electrical contact pads so that, when coupled together a plurality of the modular discs form an electrical circuit that can be used to monitor and detect the failure (e.g., damage) of modular discs in an assembly of the modular discs.

While the description of the modular discs is generally presented below with reference to functional armor for various applications, it is to be understood that the modular discs are not limited to such applications.

Figure 1:
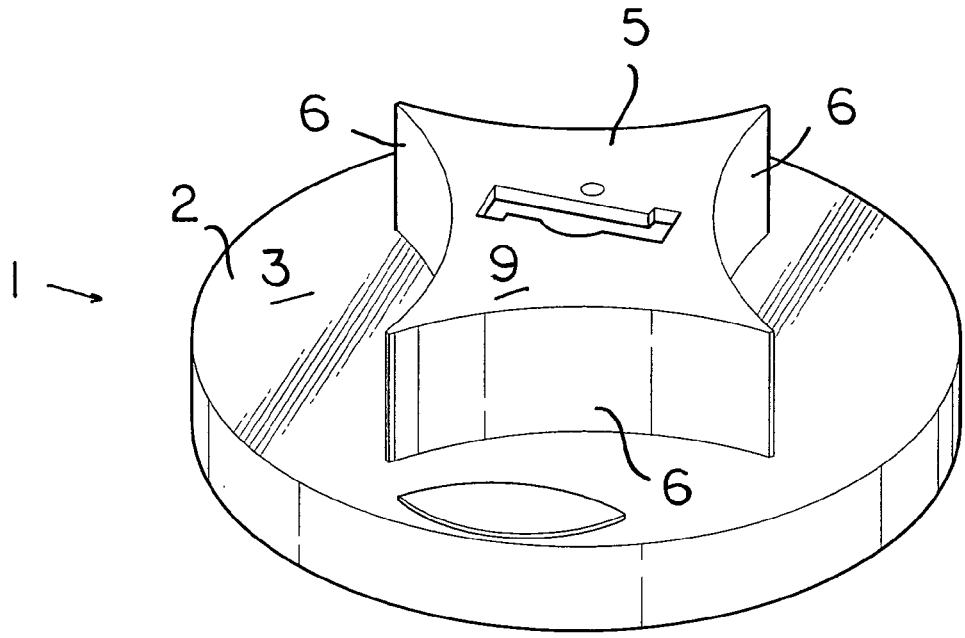
FIG. 1 is a top perspective view of a modular disc according to one embodiment of the present invention.
Figure 2:
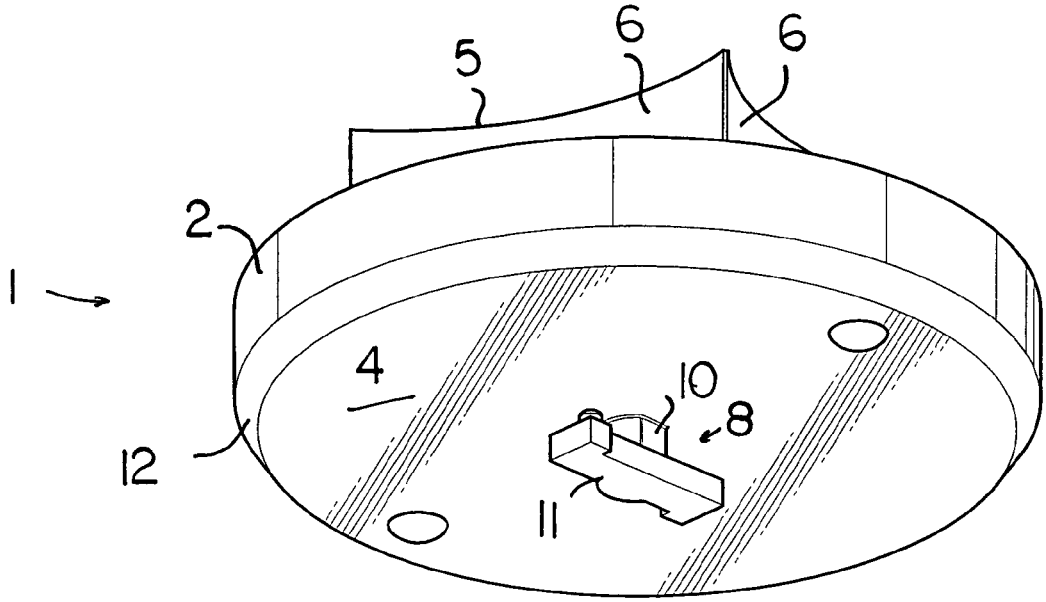
FIG. 2 is a bottom perspective view of the modular disc of FIG. 1.

FIG. 1 is a top perspective view of a modular disc according to one embodiment of the present invention. FIG. 2 is a bottom perspective view of the modular disc of FIG. 1. As shown, the modular discs 1 have a main disc-shaped portion 2 with an upper surface 3 and a bottom surface 4. A four sided star shaped projection 5 extends outward from the upper surface 3 of the main disc-shaped portion 2 as shown. The sides 6 of the star shaped projection 5 curve inwardly as shown and the radii of curvature of the sides 6 of the star shaped projection 5 is substantially the same as the radius of curvature of the main disc-shaped portion 2 of the modular disc 1. In the embodiment of the invention shown in FIGS. 1 and 2, the thickness of the star shaped projection 5 of the modular disc 1 is substantially equal to the thickness of the main disc-shaped portion 2. In alternative embodiments, the thickness of the star shaped projection 5 of the modular disc 1 and the thickness of the main disc-shaped portion 2 can differ.

A slot 7 for receiving a locking projection 8 (See FIG. 2) is provided in the upper surface 9 of the star shaped projection 5. The slot 7 has a generally elongated shape and can be keyed so as to complementarily shaped to a particular key shaped locking projection 8. The locking projection 8 extends outward from the bottom surface 4 of the modular disc 1. The locking projection 8 includes a stem or post 10 and a locking projection head 11 which is generally elongated and have a particular key shape for one-way insertion into a corresponding slot 7 on a star shaped projection 5 of another modular disc 1. Alternatively, the key shaped locking projection 8 could extend from the top 9 of the star shaped projections 5 and the bottoms 4 of the main disc-shaped portion 2 of the modular discs 1 could include the slots 7 that receive the key shaped locking projections 8. As shown in FIG. 2, the lower peripheral edge 12 of the main disc-shaped portion 3 of the modular disc 1 can be beveled or chamfered.

Figure 3:
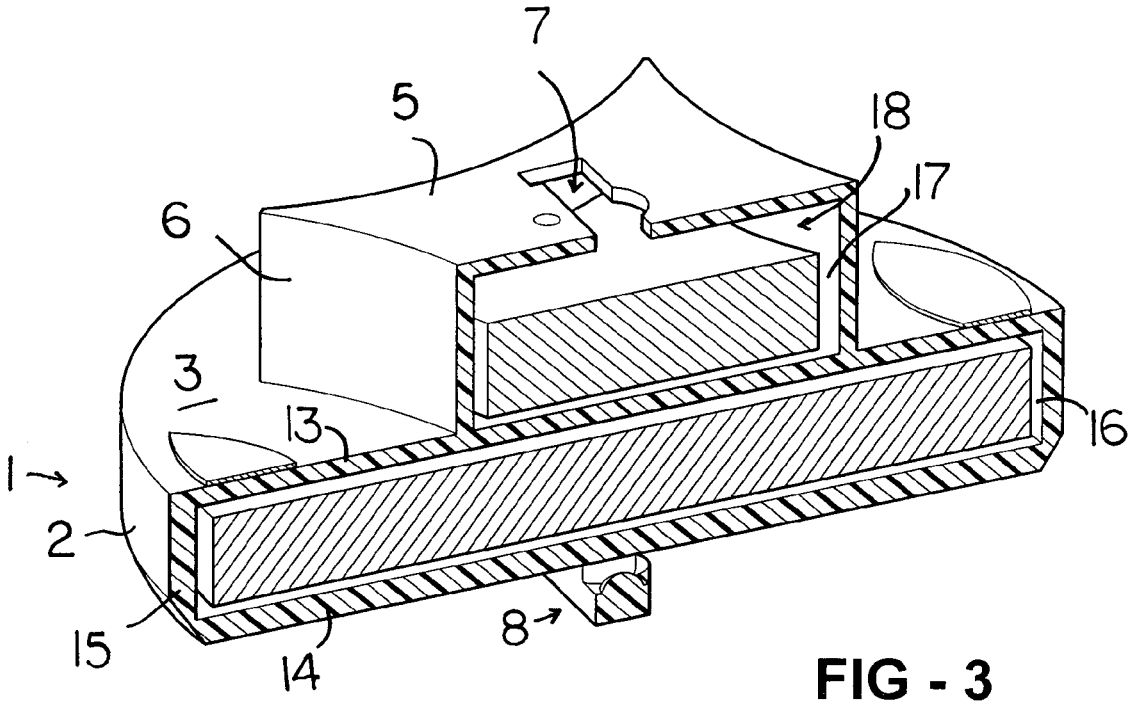
FIG. 3 is a cross-sectional view of the modular disc of FIG. 1.

FIG. 3 is a cross-sectional view of the modular disc of FIG. 1. The main disc-shaped portion 3 of the modular disc 1 is defined by a top wall 13, bottom wall 14 and peripheral side wall 15. A cavity 16 within the main disc-shaped portion 2 of the modular disc 1 can be filled with any desired material. For example, when the modular disc 1 is used to develop an armor shield, the cavity 16 within the main disc-shaped portion 2 of the modular disc 1 can be filled with a ceramic material, a plurality of laminate materials, or any other material(s) that is known to resist the impact of a projectile or absorb and dissipate the kinetic energy of a high velocity projectile. The top wall 13, bottom wall 14 and peripheral side wall 15 of the modular disc 1 can be made from any suitable rigid material such as hardened steel, a ceramic material, a composite material, etc. The star shaped projection 5 likewise has an internal cavity 17 that can be filled (in the case of a modular disc 1 that is used to develop an armor shield) with a ceramic material, a plurality of laminate materials, or any other material(s) that is know to resist the impact of a projectile. It is noted however, that a space 18 is provided in the upper portion of the cavity 17 of the star shaped projection 5 so that a locking projection head 11 of another modular disc 1 can be received and rotated therein as discussed below. If desired, the space 18 provided in the upper portion of the cavity 17 of the star shaped projection 5 can be compartmented from the cavity 17. The cavities 16 and 17 of the main disc shaped portion 2 and the star shaped portion 5 can be filled with materials, including solids, liquids or gases, that provide armament, impact protection, thermal insulation or transmission, acoustic insulation, electromagnetic shielding, etc. as desired so that a structure developed by connecting and assembling the modular discs, as discussed below, can function in a desired manner to provide armament, impact protection, thermal insulation or transmission, acoustic insulation, electromagnetic protection, etc.

According to alternative embodiments of the present invention, the main disc shaped portion 2 and/or the star shaped portion 5 of the modular disc 1 can be solid (as opposed to having internal cavities) and made from any material(s) that are suitable rigid and provide a desired armament, impact protection, thermal insulation or transmission, acoustic insulation, electromagnetic shielding, etc. function.

Figure 4:
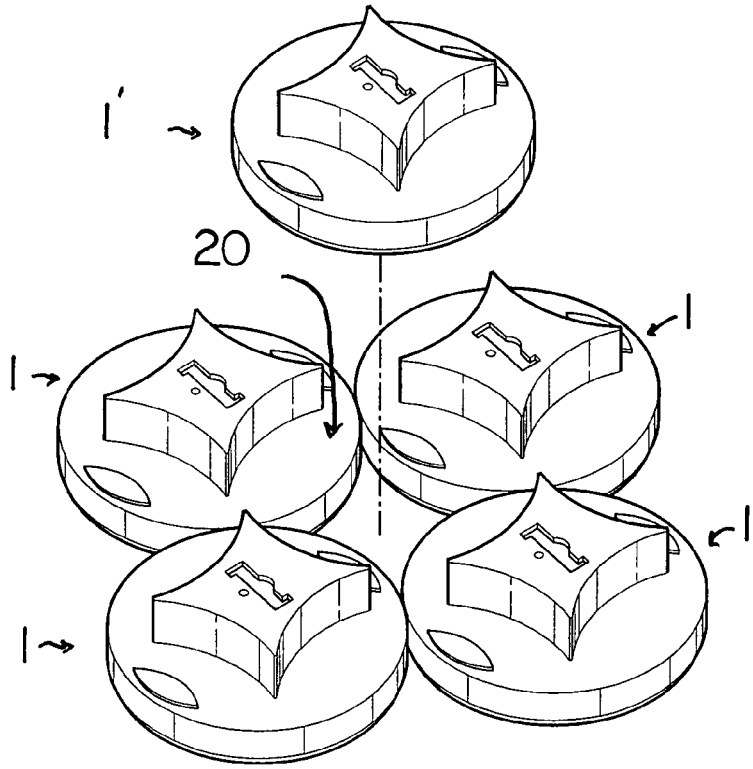
FIG. 4 is a top perspective view that shows how the modular discs of the present invention can be connected or coupled together according to one embodiment.
Figure 5:
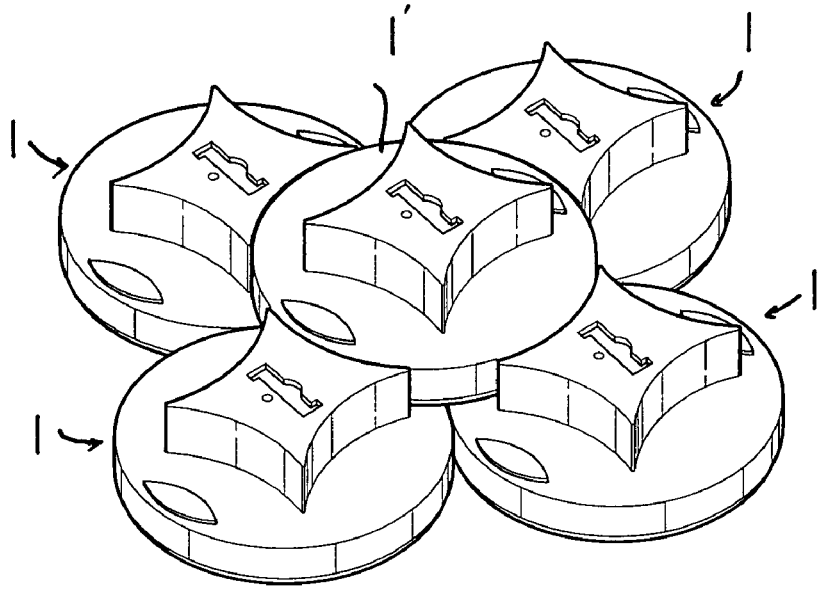
FIG. 5 is a top perspective view that shows the modular discs of FIG. 4 in their connected or coupled state.

FIG. 4 is a top perspective view that shows how the modular discs of the present invention can be connected or coupled together according to one embodiment. FIG. 5 is a top perspective view that shows the discs of FIG. 4 in their connected or coupled state. As shown in FIGS. 4 and 5 when a base of four modular discs are positioned in a symmetrical pattern, the opposed curved sides 6 of their star shaped projections 5 define a circular recess 20 into which the main disc shaped portion 2 of a fifth modular disc 1' can be received. This pattern, which can be repeated laterally and upwardly to create any desired structure, can be used to create a continuous composite structure from a plurality of the modular discs 1, 1'.

Figure 6A:
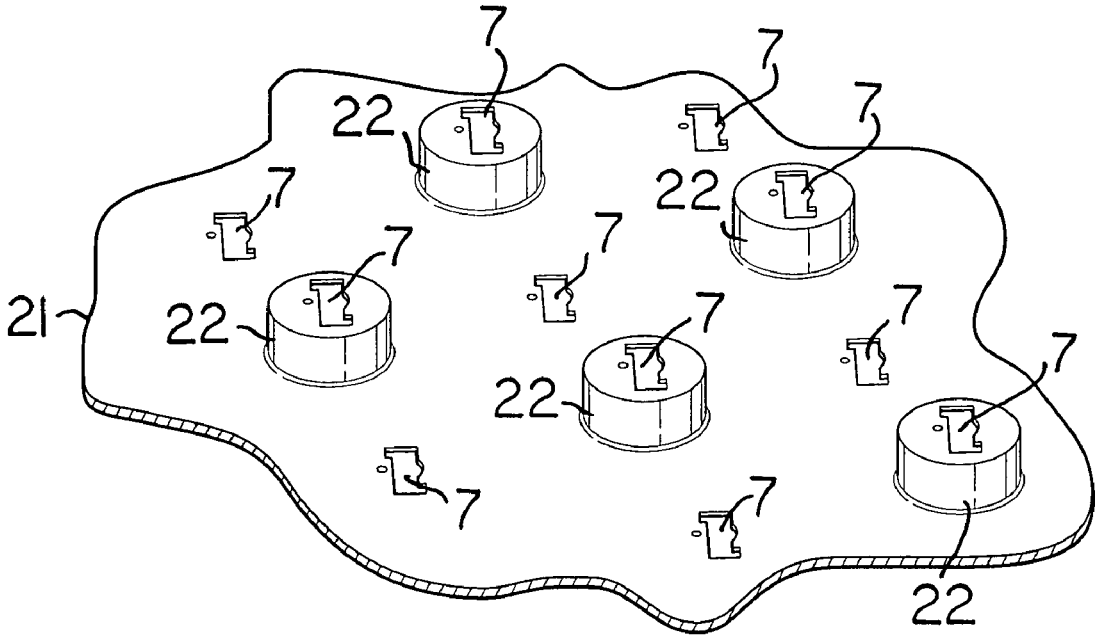
FIG. 6A is a top perspective view of a base to which modular discs of the present invention can be assembled according to one embodiment of the present invention.
Figure 6B:
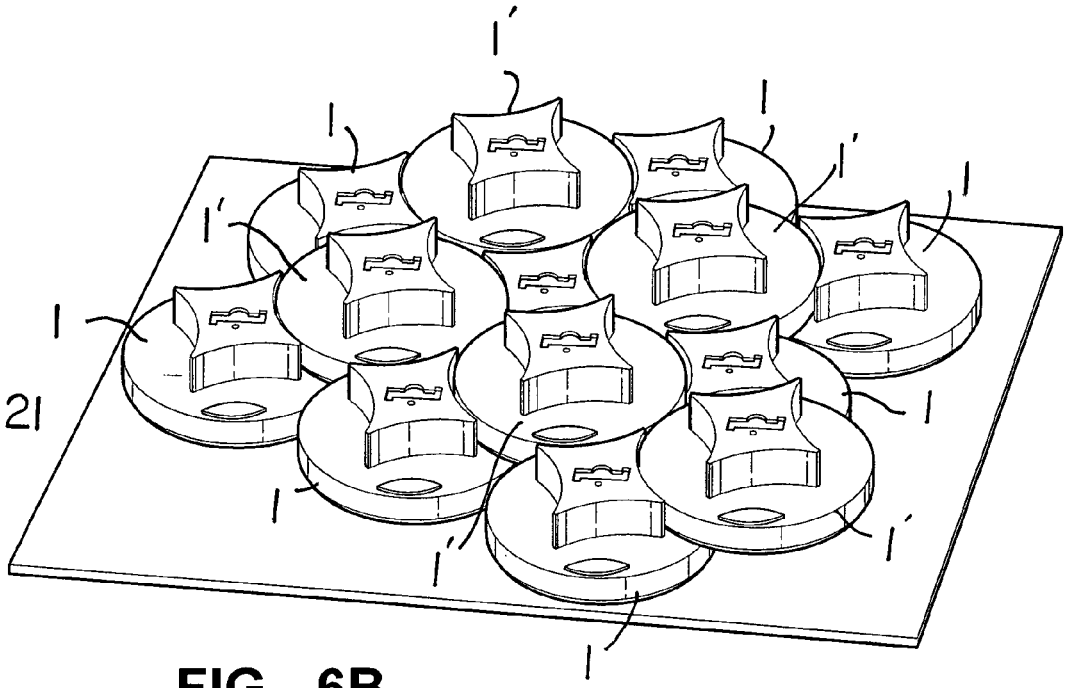
FIG. 6B is a top perspective view of a plurality of modular discs assembled to the base of FIG. 6A.

FIG. 6A is a top perspective view of a base to which modular discs of the present invention can be assembled according to one embodiment of the present invention. FIG. 6B is a top perspective view of a plurality of modular discs assembled to the base of FIG. 6A. The base 21 shown in FIG. 6A includes a plurality of slots 7 for receiving the locking projection heads 11 of the lower layer of discs 1 shown in FIG. 6B and a plurality of stand-ups 22 having slots 7 formed in upper surfaces therefore for receiving the locking projection heads 11 of the second layer of discs 1' shown in FIG. 6B. Slots 7 are shaped similarly to the slots 7 formed in the star shaped projections 5 of the modular discs 1. The base 21 can be rigid or flexible or semi-flexible as desired. As the diameters of the individual modular discs 1, 1' are reduced, the modular discs 1, 1' can be connected or interconnected so as to match the contour of non-planar surfaces/bases. Examples of rigid bases include vehicle and building structures, barricades, etc. Examples of flexible or semi-flexible bases include personal body wear, pads, blankets, etc.

It is noted that the modular discs 1 could be assembled on either side of a given support base. So that in the case of providing armor protection, the modular discs could be provided on the back side of a support base to stop a projectile that has passed through the support base or the modular discs could be provided on the front side of a support base to prevent a projectile from penetrating the support base.

Figure 7A:
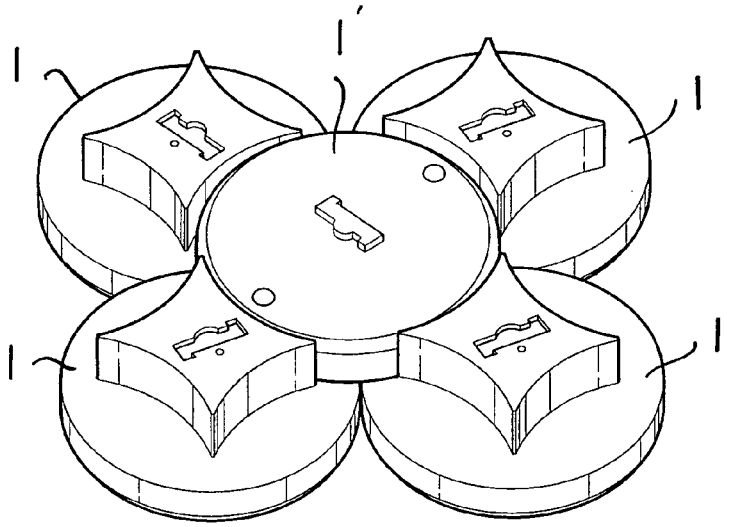
FIG. 7A is a top perspective view that shows how the modular discs of the present invention can be connected or coupled together according to another embodiment.
Figure 7B:
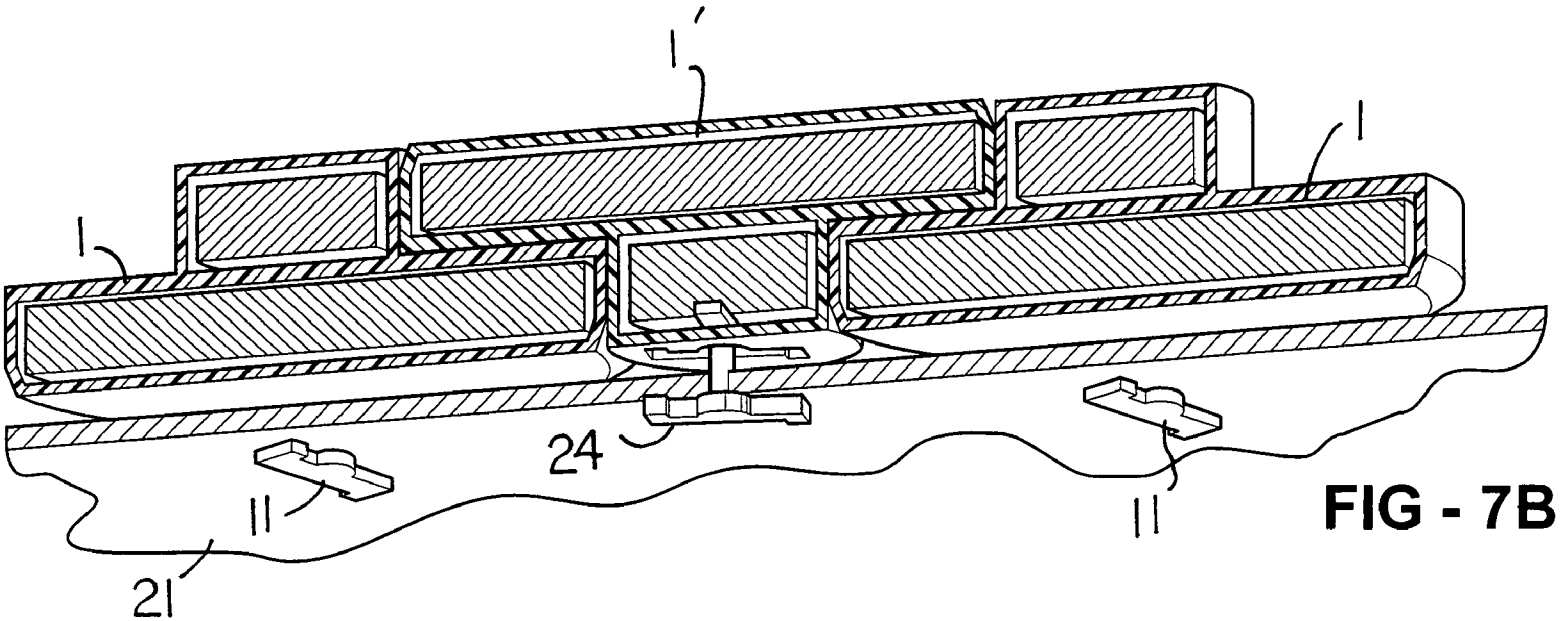
FIG. 7B is a bottom perspective view of the assembly of modular discs of FIG. 7A.
Figure 7C:
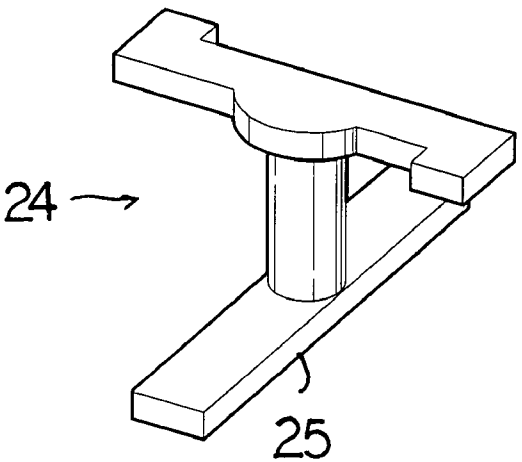
FIG. 7C is a perspective view of an adaptor that can be used to assemble or connect the modular discs as shown in FIG. 7A.

FIG. 7A is a top perspective view that shows how the modular discs of the present invention can be connected or coupled together according to another embodiment. FIG. 7B is a bottom perspective view of the assembly of modular discs of FIG. 7A. FIG. 7C is a perspective view of an adaptor that can be used to assembly or connect the modular discs as shown in FIG. 7A. In the assembly of modular discs 1 shown in FIGS. 7A and 7B, the upper modular disc 1' is upside down as compared to the assembly depicted in FIG. 5. This configuration offers a lower profile, particularly when the locking projection 8 on the upper modular disc 1' is excluded. In order to secure the upper modular disc 1' in the orientation shown in FIGS. 7A and 7B, a locking adaptor 24 shown in FIG. 7C extends through base 21 as shown in FIG. 7B. Since the star shaped portion 5 of the upper modular disc 1' prevents the upper modular disc 1' from being rotated when positioned between the lower modular discs 1, the locking adaptor 24 is rotated by manually rotating tab 25 which extends though base 21 as shown in FIG. 7B.

Figure 8:
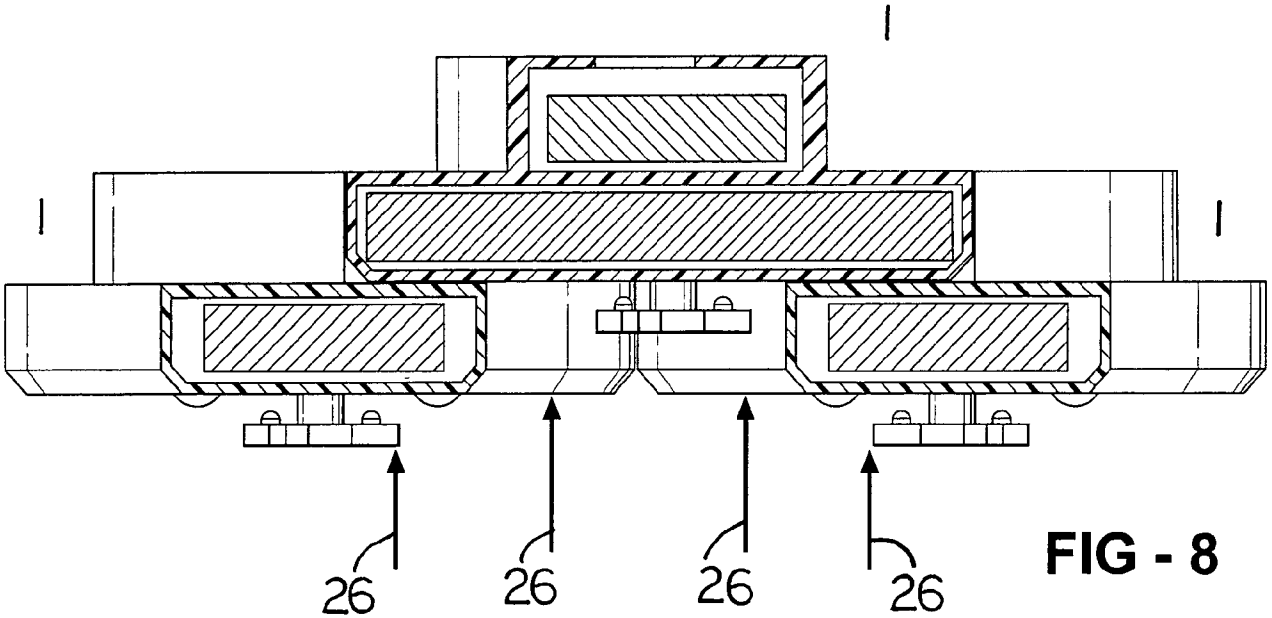
FIG. 8 is a cross-sectional view which depicts alternative paths of bullets through a stack of modular discs of the present invention.

FIG. 8 is a cross-sectional view which depicts alternative paths of bullets through a stack of modular discs of the present invention. As discussed above, alternate layers of modular discs 1 which are connected or interconnected together overlap so as to from a continuous composite structure. Such a structure which is shown in FIG. 8, when incorporating a material that is know to resist the impact of ballistic projectiles, provides protection against virtually any path 26 a bullet (or other ballistic projectile) might otherwise take to pass through the composite structure.

Figure 9C:
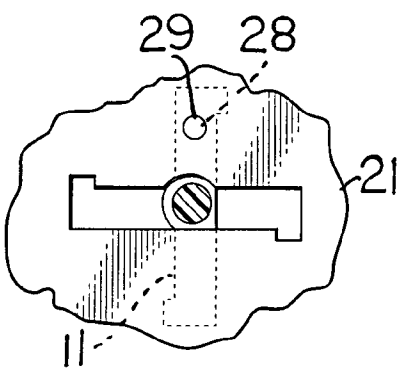
FIGS. 9A-9C depict one manner in which the locking extension of the modular discs can be configured to provide a positive locking function.
Figure 9B:
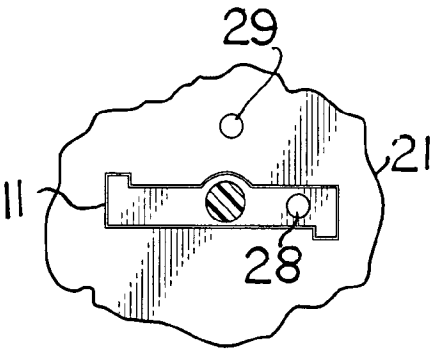
Figure 9A:
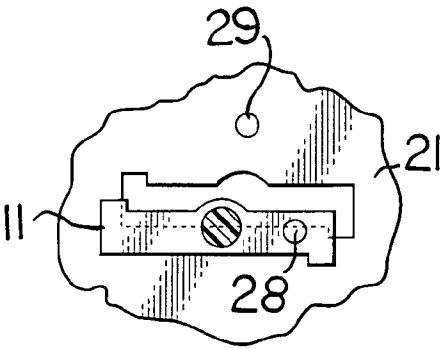

FIGS. 9A-9C depict one manner in which the locking extension of the modular discs can be configured to provide a positive locking function. FIGS. 9A-9C illustrate how the locking projection heads 11 extend though a base 21 upon which a composite structure of modular discs 1 is assembled. As shown, the locking projection head 11 can have a uniquely keyed shape which only allows a modular disc 1 having a particular locking projection head 11 to be assembled to a particular base 21 or other modular disc 1. In this manner modular discs that are designed to provide a particular function such as an armament function cannot be accidentally coupled to modular discs that are designed to provide a different function such as thermal insulation.

The surface of the locking projection head 11 which faces the bottom of the base 21 includes a detent structure 28 or mechanism such as a small solid or spring biased projection. This detent structure 28 is configured to be received in a complementarily shaped recess or bore 29 formed in the bottom surface of the base 21. As a modular disc 1 having the locking projection head 11 is coupled to and rotated with respect to the base 21, the detent structure 28 will engage the recess or bore 29 and thereby provide positive feedback that indicates that the modular disc 1 is properly locked in place in a composite assembly. A similar recess or bore 29 can be provided on the inner surface of the top wall of the star shaped projections 5 to provide positive feedback when subsequent layers of modular discs 1 are assembled together.

Figure 10A:
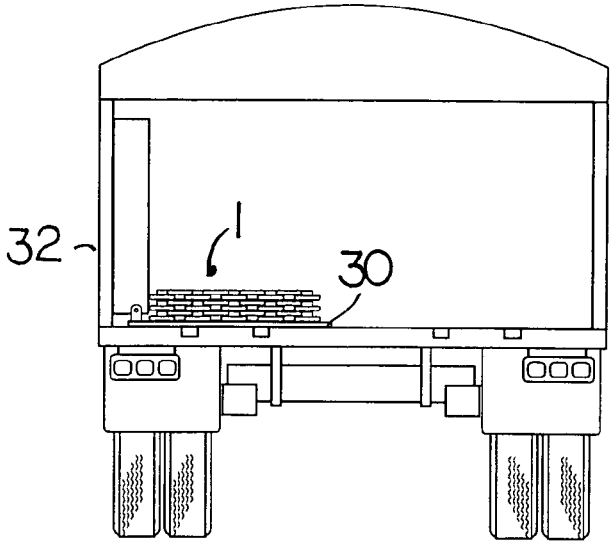
FIGS. 10A-10F depict various ways that the modular discs of the present invention can be incorporated into an armor shield for vehicles.
Figure 10B:
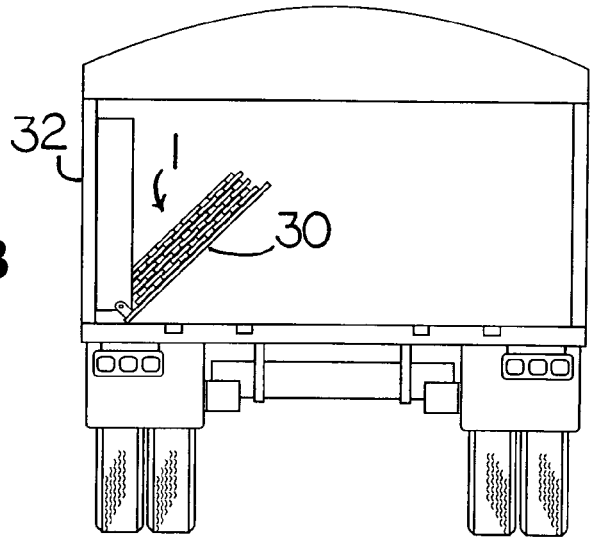
Figure 10C:
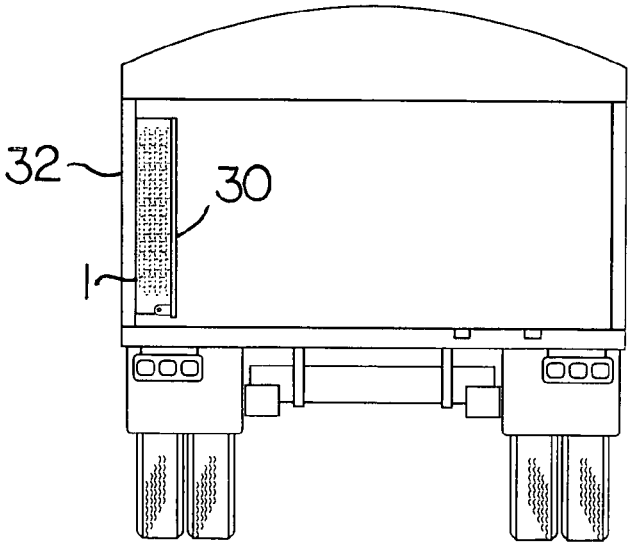
Figure 10D:
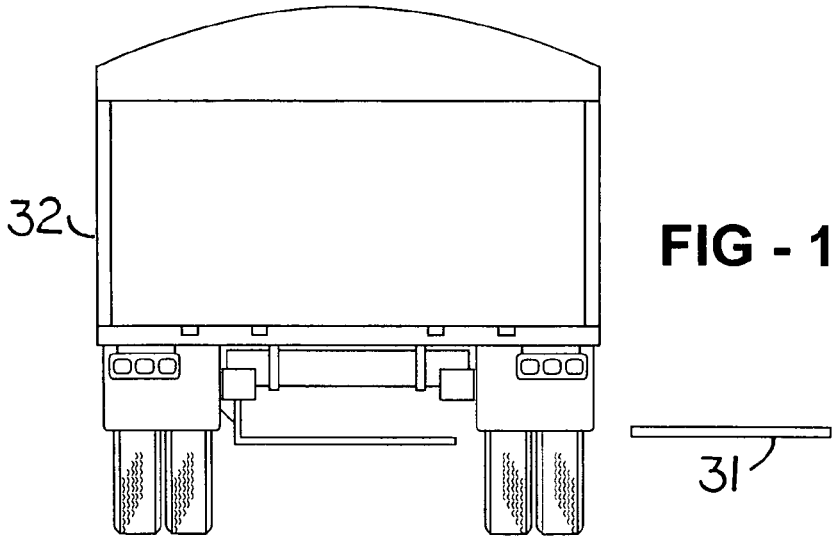
Figure 10E:
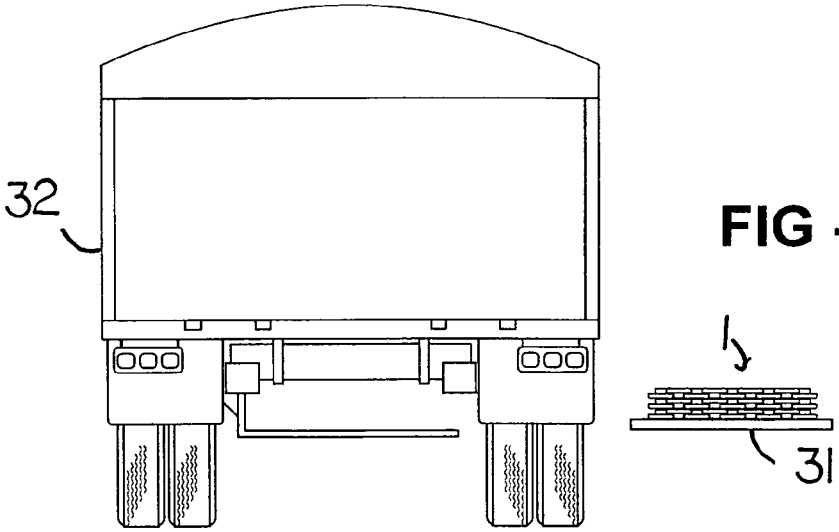
Figure 10F:
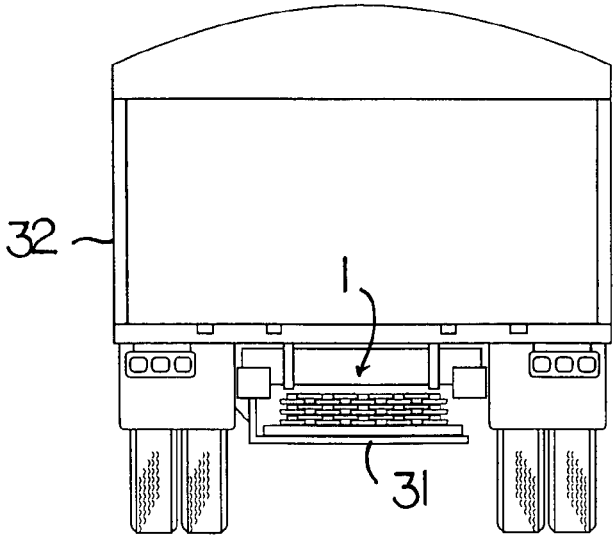

FIGS. 10A-10F depict various ways that the modular discs of the present invention can be incorporated into an armor shield for vehicles. In FIGS. 10A-10F modular discs 1 are coupled to support bases 30 and 31. Support base 30 is hinged to a lower portion of the side of vehicle 32 so that the base 30 can be laid flat as shown in FIG. 10A or pivoted and secured in a vertical position as shown in FIG. 10C to provide an armor shield for the side(s) of the vehicle. The armor shield can be assembled or repaired when the base 30 is in the position shown in FIG. 10A. Support base 31 can be slid out from beneath a vehicle 32 as shown in FIG. 10D so that an armor shield for the bottom of the vehicle 32 can be assembled or repair. Thereafter, the support base 31, with the armor shield thereon, can be slid beneath the vehicle 32 as shown in FIG. 10F. It is noted that the either of the support bases 30 and 31 can be slid, pivoted or removable fastened into any desired position with respect to the vehicle.

Figure 11C:
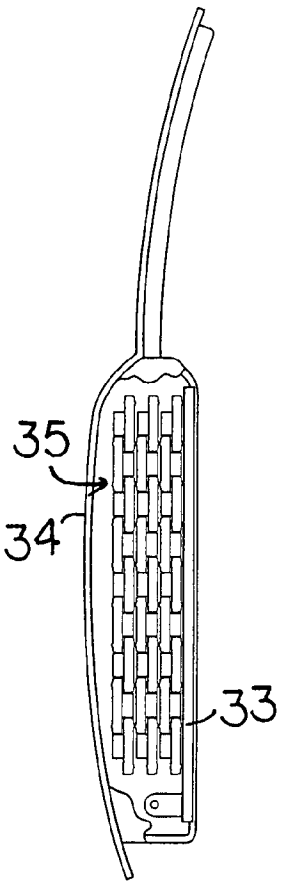
FIGS. 11A-11C depict how the modular discs of the present invention can be incorporated into a vehicle door assembly.
Figure 11B:
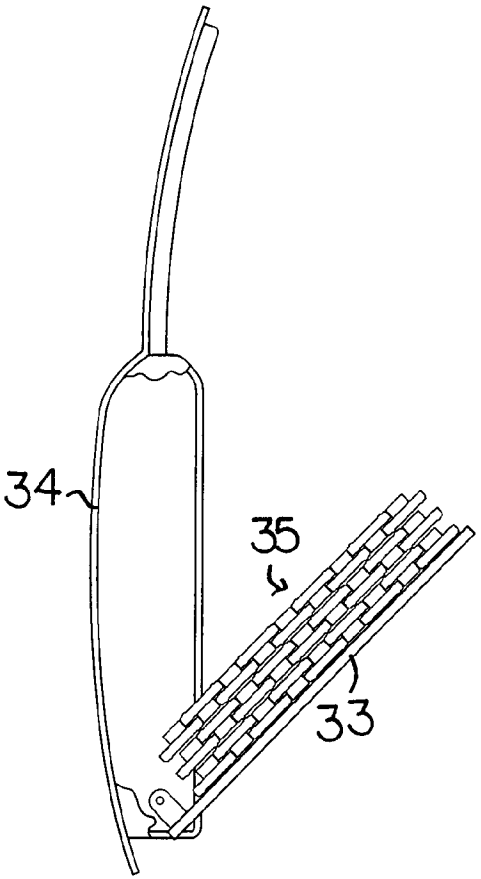
Figure 11A:
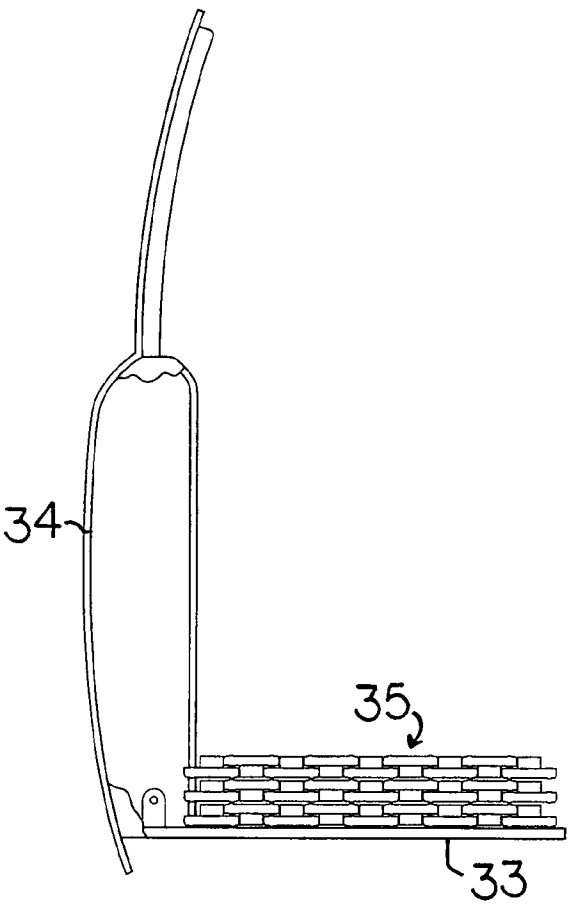

FIGS. 11A-11C depict how the modular discs of the present invention can be incorporated into a vehicle door assembly. In a manner similar to the support base 30 shown in FIGS. 10A-10C, a support base 33 can be configured to fit into the door assembly 34 of a vehicle and be hinged to the door assembly 34 so as to be pivoted into position shown in FIG. 11A in which an armor shield 35 can be assembled or repaired on the support base 3. Once the armor shield 35 is assembled or repaired, the support base 33 with the armor shield 35 thereon can be pivoted into a vertical position in the door assembly 34 to provide protection for the side of the door/vehicle.

FIGS. 10A-10F and 11A-11C are non-limited examples of how to incorporate armor shields into vehicles. It is to be understood that the modular discs 1 of the present invention can be assembled into virtually any position with respect to a vehicle whether using a separately positioned support base or using a fixed structure of the vehicle as a support upon which to assembly the modular discs.

Figure 12A:
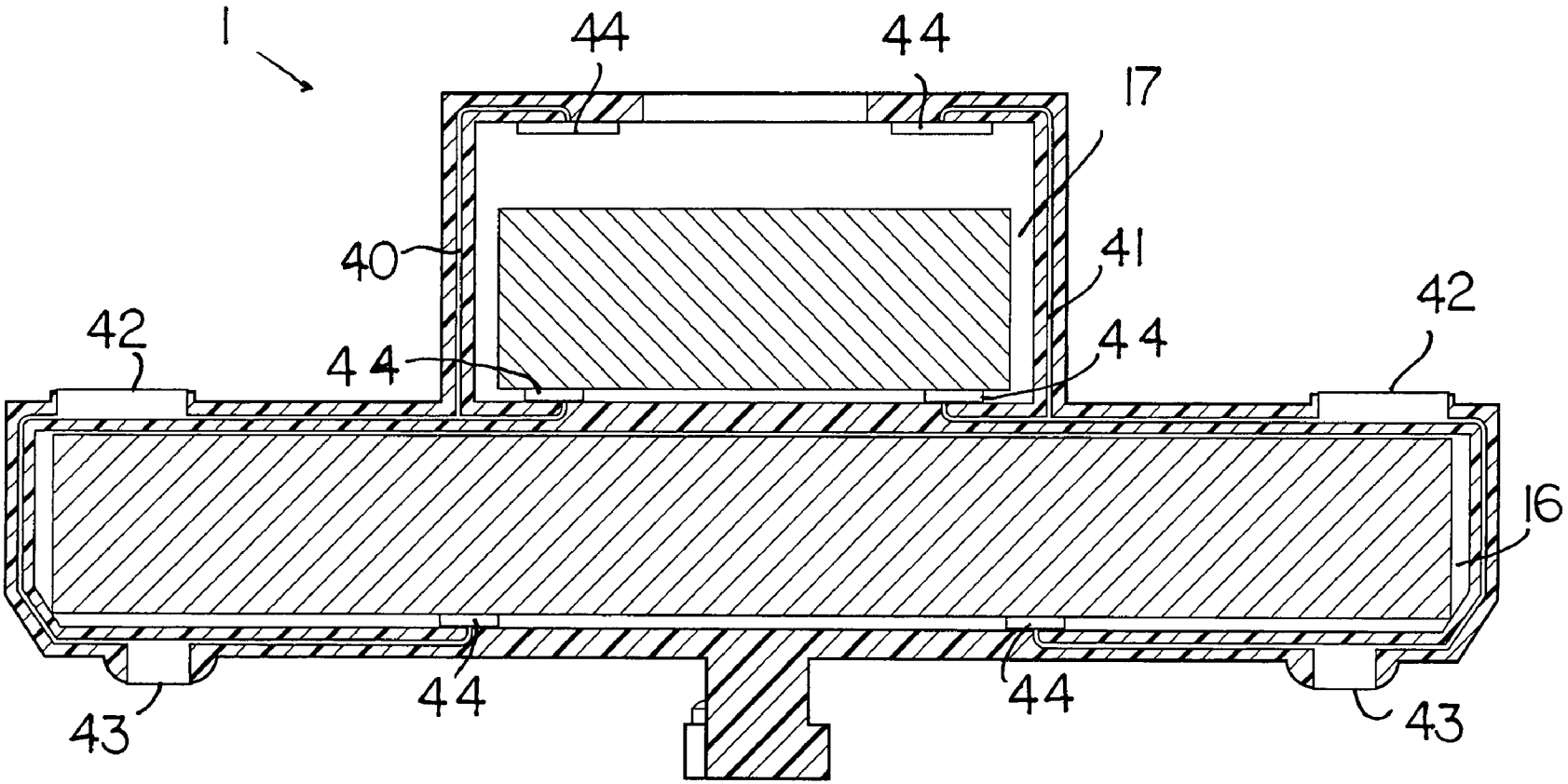
FIG. 12A is a cross-sectional view of a modular disc that is provided with electrical leads.

FIG. 12A is a cross-sectional view of a modular disc that is provided with electrical leads. The modular disc 1 shown in FIG. 12A is provided with electrical leads 40 and 41 that include external contact pads 42, 43 (also shown, but not labeled in the other figures) and internal contacts 44 that are in electrical communication with the materials that are contained in cavities 16 and 17 in the main disc portion 2 and star shaped projection 5. These electrical leads 40 and 41 allow an electrical potential to be established across the main disc portion 2 and star shaped projection 5 and/or across the materials that are contained in cavities 16 and 17 in the main disc portion 2 and star shaped projection 5.

Figure 12B:
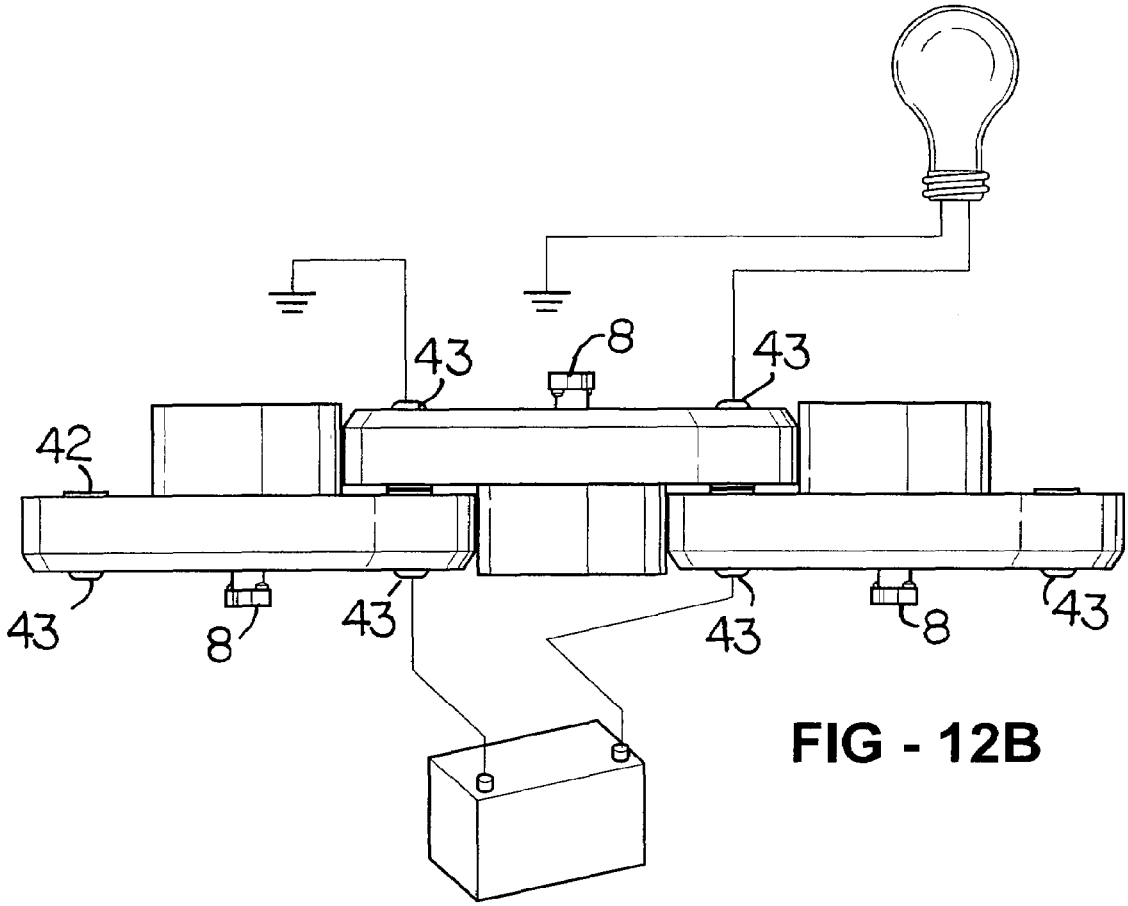
FIG. 12B is a cross-sectional view of an assembly of interconnected modular discs in an electrical circuit.
Figure 12C:
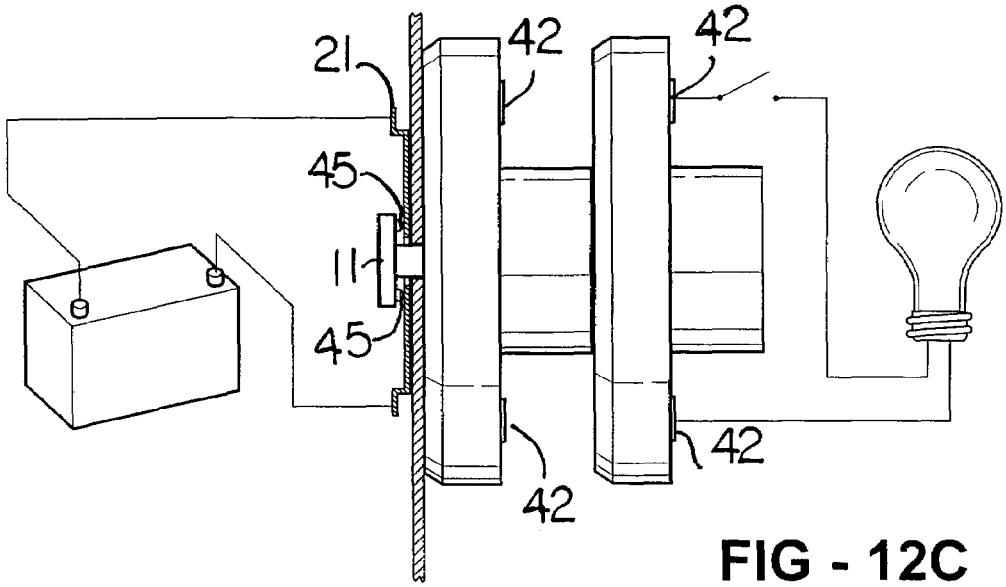
FIG. 12C is a cross-sectional view of another assembly of interconnected modular discs in an electrical circuit.

FIG. 12B is a cross-sectional view of an assembly of interconnected modular discs in an electrical circuit. FIG. 12C is a cross-sectional view of another assembly of interconnected modular discs in an electrical circuit. With the electrical leads 40 and 41 shown in FIG. 12A an assembly of modular discs 1 as shown in FIGS. 12B or 12C can be coupled together so that an electrical circuit extends across two or more modular discs 1 that are coupled together. In this regard, the configuration of the locking projections 8 when properly keyed to ensure a desired orientation will enable the external contacts 42, 43 on adjacent modular discs 1 to establish electrical connection so that an electrical potential can be established across an entire assembly of modular discs 1. Such an arrangement will allow quick determination of any damage to one or more of the modular discs 1 of an assembly of modular discs 1. Such determination will allow real time monitoring of armored shields of military or civilian vehicles, or any other assembly of modular discs 1 according to the present invention.

It is noted that in FIG. 12C the locking projection head 11 is also provided with electrical leads and external contact pads 45 with are in electrical communication with the underlying base support 21 or a circuit provided thereon. Such locking heads 11 provided with electrical leads and external contact pads 45 enable electrical connection between and though adjacent modular discs 1 that are coupled together by the locking projection heads 11.

Figure 13A:
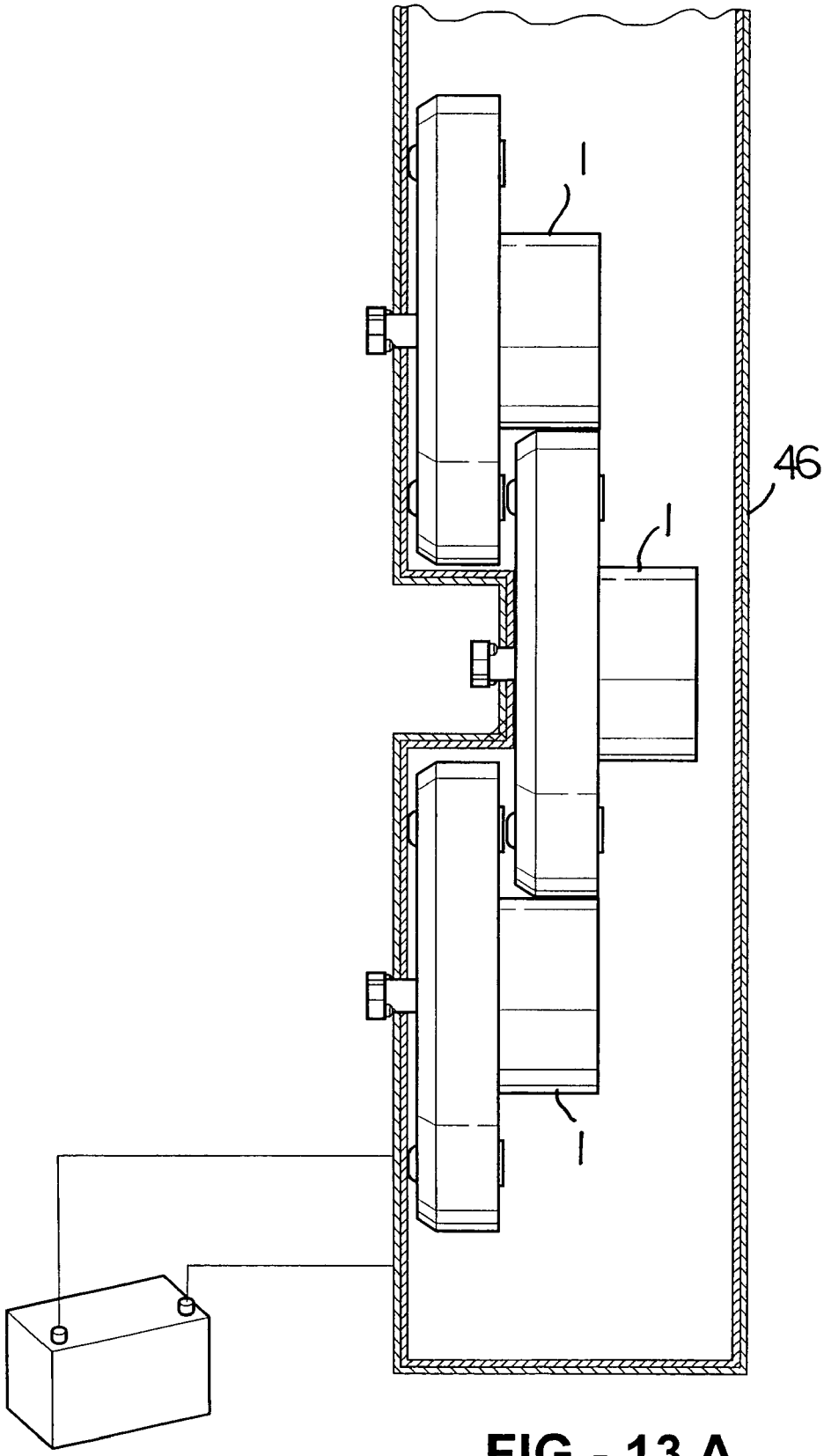
FIGS. 13A and 13B are drawings of an assembly of interconnected modular discs with a sensor grid disposed in front of the assembly.
Figure 13B:
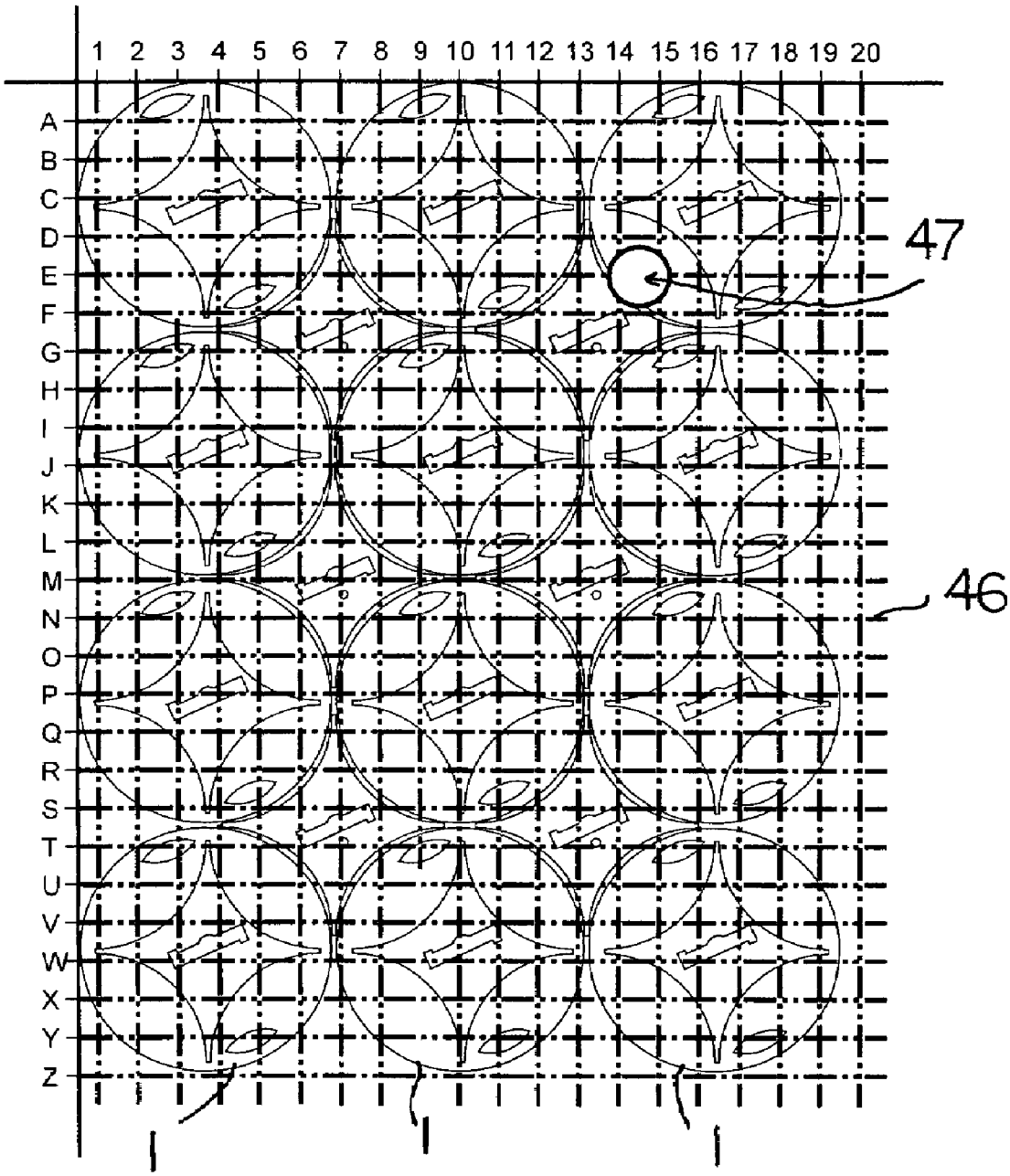

FIGS. 13A and 13B are drawings of an assembly of interconnected modular discs with a sensor grid disposed in front of the assembly. According to one embodiment of the present invention, the modular discs can 1 include an "active" armament function in which, for example the modular discs 1 can include an explosive charge or otherwise provided with an electrical potential that interacts with a projectile upon impact. In such cases, a sensor grid 26 which can be in the form of a matrix circuit is provided in from of an assembly of the modular discs 1. When a projectile strikes the sensor grid 46 the position of the projectile is determined by the sensor grid 46 and an electrical charge can be immediately applied to one or more of the modular discs 1 which is/are directly aligned with the point of impact of the projectile. This electric charge can cause an explosive charge in the individual modular discs 1 to ignite and thereby provide a force that counteracts the force of the projectile or otherwise cause the projectile designed to explode upon impact to prematurely explode. In addition to the explosive charge, the individual modular discs 1 could also include particles, plates, etc, of metals, ceramics etc. that the explosive charge would propel into the direction of the oncoming projective. Alternatively, the electrical charge that is immediately applied to one or more of the modular discs 1 which is/are directly aligned with the point of impact of the projectile could interact with a projectile upon impact.

In an alternative embodiment, a sensor grid could be provided on or near the inside surface of a armor shield formed by an assembly of the modular discs 1 and used to determine the position of modular discs 1 that are damaged, for example, by being struck by a projectile. In this case the sensor grid would be similar to that of FIGS. 13A and 13B and would be connected to a display that would indicate the position of any damaged modular disc or penetration or impact from a projectile. Otherwise the sensor grid could be provided with an array of LED's that could be selectively activated to indicate the position of any damaged modular disc or penetration or impact from a projectile.

Further embodiments of the modular discs 1 include modular discs that are made from thermal insulating materials which can be assembled into structures, including surface layers on space craft that function as heat shields.

In addition modular discs 1 according to the present invention could be made from radar-absorbing materials and used to assembly structures, including surface layers on airplanes and military vehicles, which function to limit detection by radar.

In other embodiments, the modular discs 1 of the present invention could be individual solar cells that are configured to generate electrical energy from exposure to sunlight. Such modular solar cell discs would include the external contact pads 42, 43 discussed above so that an assembly or array of the modular solar cells discs could be electrically interconnected to collect and utilize electricity produced by the each of the individual modular solar cells discs external contact pads 42, 43 could be electrically connected to internal contacts of the individual solar cells.

In another embodiment, the modular discs could be made from acoustic absorbing or acoustic reflecting materials and assembled together to construct structures for music recording studios or auditoriums, theaters, conference rooms, etc. In other embodiments the modular discs could be made from sound generating materials such as speaker materials and used individually or as an assembly to provide sound generating structures.

In other embodiments, the modular discs could be made from energy shielding materials such as, for example, materials that are configured to shield against electromagnetic energy or electromagnetic pulses, and used to assembly various shields for electronic equipments, personnel, etc.

In further embodiments, the modular discs can include the electrical leads discussed above and a camera. One or more of such discs having cameras therein could be installed at the front of a barrier structure and the electrical circuit formed through the connected discs could transmit field images to personnel who are positioned safely behind such a barrier.

In further embodiments the modular discs could be assembled to for a roof or portion of a roof and could comprises materials that produce a moisture barrier or provide thermal heating.

As can be understood from the above non-limiting examples, the modular construction system of the present invention is based upon the particular configuration of the modular discs which configuration allows for the construction of a variety of structural units. The particular functionality of such structural units is dependent on the particular materials from which the modular discs are made. Thus, there is almost an unlimited function that the resulting structures or assemblies can have including, but not limited to, armor shields for vehicles and personnel, energy generating grids, and thermal or acoustic insulating structures.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A modular construction system for assembling structural units which comprises a plurality of modular discs, each of said plurality of modular discs comprising:

a substantially circular base portion having an upper surface, a lower surface and a radius;

a star-shaped projection extending from the upper surface of the substantially circular base portion, said star-shaped projection having an upper surface and four inwardly curved side walls wherein the four inwardly curved side walls have a radius of curvature that is substantially equal to the radius of the substantially circular base portion; and cooperating connecting structures provided on the lower surface of the substantially circular base portion and on the upper surface of the star-shaped projection which cooperating connecting structures allow for the plurality of modular discs to be connected to one another.

2. A modular construction system for assembling structural units according to claim 1, wherein the plurality of modular discs are made from a material that can absorb and dissipate the kinetic energy of a high velocity projectile.

3. A modular construction system for assembling structural units according to claim 2, wherein the plurality of modular discs are made from a ceramic material.

4. A modular construction system for assembling structural units according to claim 1, wherein the plurality of modular discs are made from one of a thermally insulating material and a thermal conducting material.

5. A modular construction system for assembling structural units according to claim 1, wherein the plurality of modular discs are made from one of an acoustic absorbing material, an acoustic reflecting material and a sound generating material.

6. A modular construction system for assembling structural units according to claim 1, wherein the plurality of modular discs are made from a material that shields against electromagnetic energy.

7. A modular construction system for assembling structural units according to claim 1, wherein the cooperating connecting structures which allow for the plurality of modular discs to be connected to one another comprise keyed locking structures.

8. A modular construction system for assembling structural units according to claim 1, wherein the a cooperating connecting structures comprise a locking projection provided on one of the lower surface of the substantially circular base portion and the upper surface of the star-shaped projection and a complimentarily shaped slot of the other of the lower surface of the substantially circular base portion and the upper surface of the star-shaped projection.

9. A modular construction system for assembling structural units according to claim 8, wherein the locking projection and the slot are configured so that the locking projection can be inserted into the slot and rotated to lock the plurality of modular discs together.

10. A modular construction system for assembling structural units according to claim 9, wherein the locking projection includes a detent mechanism that engages when two of the plurality of modular discs are locked together.

11. A modular construction system for assembling structural units according to claim 1, wherein the substantially circular base portion and the star-shaped projection comprise casings that include internal cavities.

12. A modular construction system for assembling structural units according to claim 1, further comprising a support base which includes cooperating connecting structures which allow the plurality of discs to be connected to the support base.

13. A modular construction system for assembling structural units according to claim 12, wherein in the support base is rigid.

14. A modular construction system for assembling structural units according to claim 12, wherein in the support base is flexible or semi-flexible.

15. A modular construction system for assembling structural units according to claim 13, wherein in the support base comprises a portion of a vehicle.

16. A modular construction system for assembling structural units according to claim 14, wherein in the support base comprises an article of clothing.

17. A modular construction system for assembling structural units according to claim 1, wherein each of the plurality of discs include electrical leads and external electrical contact pads.

18. A modular construction system for assembling structural units according to claim 1, wherein each of the plurality of discs comprise solar cells.

19. A method of assembling a structure which comprises:

a) providing a plurality of modular discs, each of said plurality of modular discs comprising:

i) a substantially circular base portion having an upper surface, a lower surface and a radius;

ii) a star-shaped projection extending from the upper surface of the substantially circular base portion, said star-shaped projection having an upper surface and four inwardly curved side walls wherein the four inwardly curved side walls have a radius of curvature that is substantially equal to the radius of the substantially circular base portion; and iii) cooperating connecting structures provided on the lower surface of the substantially circular base portion and on the upper surface of the star-shaped projection which cooperating connecting structures allow for the plurality of modular discs to be connected to one another; and b) connecting the plurality of modular discs together to form a structure.

20. A method of assembling a structure according to claim 19, wherein the assembled structure comprises at least one of an armor shield for vehicles or personnel, an energy generating grid, a thermal insulating or transmitting structure, an acoustic insulating or reflecting structure, and an electromagnetic shield.

* * * * *